US008087400B2

(12) United States Patent
Achleitner et al.

(10) Patent No.: US 8,087,400 B2
(45) Date of Patent: Jan. 3, 2012

(54) METHOD AND DEVICE FOR METERING A FLUID

(75) Inventors: Erwin Achleitner, Obertaubling (DE); Dirk Baranowski, Regensburg (DE); Franz Kunz, Neunkirchen am Brand (DE)

(73) Assignee: Continental Automotive GmbH, Hannover (DE)

( * ) Notice: Subject to any disclaimer, the term of this patent is extended or adjusted under 35 U.S.C. 154(b) by 772 days.

(21) Appl. No.: 12/234,813

(22) Filed: Sep. 22, 2008

(65) Prior Publication Data

US 2009/0078799 A1 Mar. 26, 2009

(30) Foreign Application Priority Data

Sep. 24, 2007 (DE) ..... 10 2007 045 513

(51) Int. Cl.
*F02M 51/00* (2006.01)

(52) U.S. Cl. ..... 123/490; 123/467; 123/445; 123/472; 701/104; 701/107

(58) Field of Classification Search ..... 137/487.5; 123/299, 304, 339.2, 339.21, 395, 406.19, 123/445, 467, 472, 478, 479, 499, 480; 239/585.1; 251/129.01; 701/103, 104, 107, 114, 115
See application file for complete search history.

(56) References Cited

U.S. PATENT DOCUMENTS

| | | | | |
|---|---|---|---|---|
| 4,718,386 | A * | 1/1988 | Gieles | 123/472 |
| 5,267,545 | A * | 12/1993 | Kitson | 123/490 |
| 5,895,844 | A * | 4/1999 | Krueger | 73/114.72 |
| 6,283,095 | B1 * | 9/2001 | Krueger | 123/499 |
| 6,298,829 | B1 * | 10/2001 | Welch et al. | 123/467 |
| 6,415,762 | B1 * | 7/2002 | Hafner et al. | 123/300 |
| 6,457,457 | B1 * | 10/2002 | Harcombe | 123/490 |
| 6,575,138 | B2 * | 6/2003 | Welch et al. | 123/467 |
| 6,981,489 | B2 * | 1/2006 | Petrone et al. | 123/490 |
| 7,467,619 | B2 * | 12/2008 | Sheikh et al. | 123/490 |
| 7,835,850 | B2 * | 11/2010 | Nakata et al. | 701/104 |
| 7,984,706 | B2 * | 7/2011 | Stewart et al. | 123/467 |
| 2002/0195081 | A1 * | 12/2002 | McGee et al. | 123/299 |
| 2003/0029414 | A1 * | 2/2003 | Boss et al. | 123/294 |
| 2004/0000294 | A1 * | 1/2004 | Frankl et al. | 123/480 |
| 2007/0028895 | A1 * | 2/2007 | Fujii | 123/446 |
| 2007/0068484 | A1 * | 3/2007 | Dietl et al. | 123/299 |
| 2007/0169752 | A1 * | 7/2007 | Snopko et al. | 123/467 |
| 2008/0289607 | A1 * | 11/2008 | Mayuzumi et al. | 123/490 |
| 2009/0204315 | A1 * | 8/2009 | Aspelmayr et al. | 701/115 |
| 2010/0116911 | A1 * | 5/2010 | Fritsch et al. | 239/580 |

FOREIGN PATENT DOCUMENTS

| | | |
|---|---|---|
| DE | 10035815 | 7/2000 |
| DE | 10138483 | 8/2001 |

* cited by examiner

*Primary Examiner* — John Rivell
*Assistant Examiner* — Minh Le
(74) *Attorney, Agent, or Firm* — King & Spalding L.L.P.

(57) ABSTRACT

An injection valve has a magnetic actuator and an injector needle able to be moved axially by the magnetic actuator. To meter a fluid by the injection valve the magnetic actuator is activated for an individual metering process with at least one actuation signal with a first or second signal waveform. The two actuation signals differ from one another in that, on activation of the magnetic actuator by the actuation signal with the first signal waveform, less energy is transmitted to a magnet unit of the magnetic actuator than during activation of the magnetic actuator by the actuation signal with the second signal waveform. The magnetic actuator is activated by the actuation signal with the second signal waveform if an activation of the magnetic actuator by the actuation signal with the first signal waveform leads to an undesired premature closure of the injector needle.

18 Claims, 3 Drawing Sheets

METHOD AND DEVICE FOR METERING A FLUID

CROSS-REFERENCE TO RELATED APPLICATIONS

This application claims priority to German Patent Application No. 10 2007 045 513.7 filed Sep. 24, 2007, the contents of which is incorporated herein by reference in its entirety.

TECHNICAL FIELD

The invention relates to a method and a device for metering a fluid by means of an injection valve. The injection valve comprises a magnetic actuator and an injector needle able to be moved axially by means of the magnetic actuator.

BACKGROUND

With an injection valve with a magnetic actuator the magnetic actuator can be charged up with energy so that initially energy is stored as magnetic energy in the magnetic actuator without the injection valve releasing a flow of fluid. Subsequent to the charging an opening phase can occur in which an injector needle of the injection valve releases a flow of fluid through a metering opening of the injection valve. The opening phase can be followed by a hold phase in which the injector needle is held outside its closed position. These three phases can for example be implemented by a predetermined signal waveform of an actuation signal for the magnetic actuator. The actuation signal with the predetermined signal waveform is generated by an output stage comprising electronic components. The output stage and the injection valve form a metering system.

The magnetic actuation drive operates for example against a nozzle spring which applies a first force to the injector needle in the closing direction and which ensures that the injector needle can suppress the flow of fluid through the metering opening. A second force opposing its closing direction is applied to the injector needle by the magnetic actuator. A third force can be exerted on the injector needle by the fluid in the injection valve. This third force depends on the pressure in injection valve. Thus actuation signals with different signal waveforms can be used for controlling the injection valve, especially the magnetic actuator, depending on the pressure obtaining in the injection valve at the time.

If especially small injection masses are to be metered by means of the injection valve, the magnetic actuator must be supplied with as little energy as possible. Constructional tolerances of the components in the output stage for generating the actuation signal with the predetermined signal waveform can lead to so little energy being transferred to the magnetic actuator that the injector needle opens earlier than desired or does not open at all.

SUMMARY

A method and a device for metering a fluid can be created which contributes to a precise metering of an especially small injection mass of a fluid even with component tolerances of a metering system for metering the fluid.

According to an embodiment, a method for metering a fluid by means of an injection valve which comprises a magnetic actuator and an injector needle able to be moved axially by means of the magnetic actuator, may comprise the steps of:—activating the magnetic actuator for an individual injection process with at least one actuation signal with a first signal waveform or with an actuation signal with a second signal waveform, wherein the two actuation signals at least differ from one another in that, on activation of the magnetic actuator by means of the actuation signal with the first signal waveform, less energy is transmitted to a magnet unit of the magnetic actuator than on activation of the magnetic actuator by means of the actuation signal with the second signal waveform,—activating the magnetic actuator by means of the actuation signal with the second signal waveform if an activation of the magnetic actuator by means of the actuation signal with the first signal waveform leads to an undesired premature closure of the injector needle.

According to a further embodiment, the two signal waveforms each may feature a global maximum and a plateau in the timing waveform after the global maximum in the middle of the timing and wherein the actuation signal is used with the second signal waveform if the activation of the magnetic actuator by means of the actuation signal with the first signal waveform in the area of the plateau leads to an undesired premature closure of the injector needle. According to a further embodiment, an operating variable can be monitored, the value of which is representative of an actual value of a measured injection mass, and in which the undesired premature closure of the injector needle is detected, if a difference between the actual value of the measured injection mass and a setpoint value of the measured injection mass is greater than a first predetermined threshold value. According to a further embodiment, an operating variable can be monitored of which the value is representative for an actual value of an injection duration during which the injector needle is outside its closed position, and in which the undesired premature closure of the injector needle is detected if a difference between the actual value of the injection duration and a setpoint value of the injection duration is greater than a second predetermined threshold value. According to a further embodiment, the magnetic actuator can be activated as a function of the first actuation signal with the first signal waveform if a fluid pressure in the injection valve is smaller than a third predetermined threshold value and in which the magnetic actuator is activated as a function of the actuation signal with the second signal waveform if the fluid pressure in the injection valve is greater than the third predetermined threshold value. According to a further embodiment, during an individual injection process the magnetic actuator may initially be activated with the actuation signal with one of the two signal waveforms and then with the actuation signal with the other of the two signal waveforms.

According to another embodiment, a device for metering of a fluid by means of an injection valve, may comprise a magnetic actuator and an injector needle able to be moved axially by the magnetic actuator, wherein the device is operable:—to activate the magnetic actuator for an individual injection process with at least one actuation signal with a first signal waveform or with an actuation signal with a second signal waveform, wherein the two actuation signals at least differing from each other in that, on activation of the magnetic actuator by means of the actuation signal with the first signal waveform less energy is transmitted to a magnet unit of the magnetic actuator than during activation of the magnetic actuator by means of the actuation signal with the second signal waveform, and—to activate the magnetic actuator by means of the actuation signal with the second signal waveform if an activation of the magnetic actuator by means of the actuation signal with the first signal waveform leads to an undesired premature closure of the injector needle.

BRIEF DESCRIPTION OF THE DRAWINGS

Exemplary embodiments of the invention are explained in greater detail below with reference to schematic drawings.

The figures are as follows.

Elements with identical construction or which function in the same way are identified by the same reference symbols in all figures.

DETAILED DESCRIPTION

Figure 1:
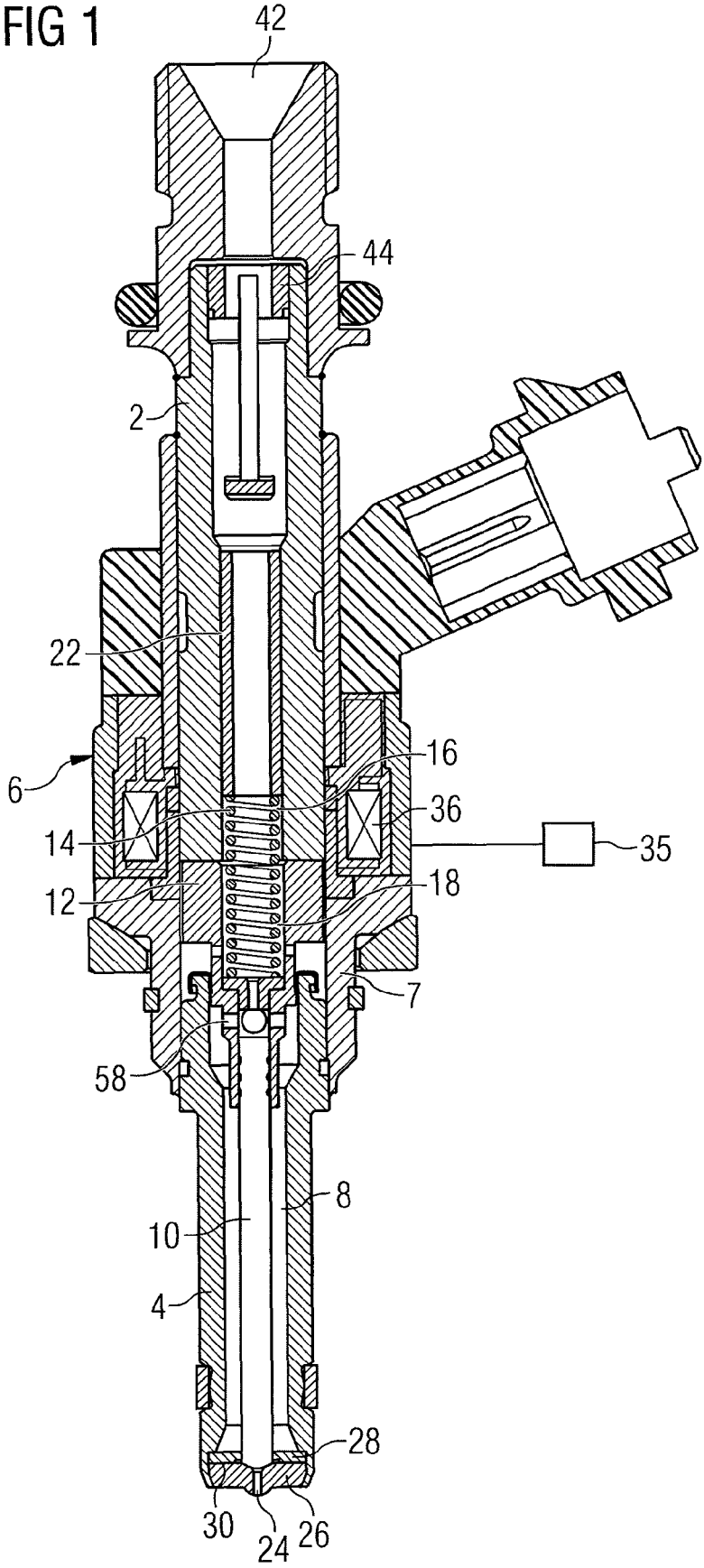
FIG. 1 an injection valve.

According to various embodiments, in a method and a device for metering of a fluid by means of an injection valve, the injection valve comprises a magnetic actuator and an injector needle able to be moved axially by the magnetic actuator. The magnetic actuator is controlled for the individual metering process with at least one actuation signal with a first signal waveform or with an actuation signal with a second signal waveform. The two actuation signals differ from each other in that when the magnetic actuator is activated by means of the activation signal with the first signal waveform less energy is transmitted to a magnet unit of the magnetic actuator than during activation of the magnetic actuator by means of the actuation signal with the second signal waveform. The magnetic actuator is activated by means of the actuation signal with the second signal waveform when an activation of the magnetic actuator by means of the actuation signal with first signal waveform leads to an undesired premature closure of the injector needle. The activation of the magnetic actuator is especially undertaken as a function of a current operating point which is predetermined for example by one or more operating variables. The activation of the magnetic actuator with the actuation signals with the different signal waveforms contributes to even especially small injection masses being able to be metered precisely, since with the premature closure of the injector needle, for example because of component tolerances, an automatic switchover can be made to the signal waveform with the higher energy amount. In addition a metering time can then be reduced during which the individual metering process occurs.

If the injection valve is arranged in an internal combustion engine a magnetic actuator can thus be activated independently of an operating point of the internal combustion engine which is for example predetermined by a torque requirement for the internal combustion engine and which predetermines a mass of fuel to be metered with different signal waveforms. The metering time can then be adapted for precise implementation of the torque requirement and/or the predetermined fuel mass to be metered. In other words different signal waveforms can be used at the same operating point, for example depending on component tolerances of an output stage for activating the magnetic actuator and/or on elements of the injection valve.

In an embodiment the two signal waveforms each have a global maximum and in the time which elapses after the global maximum they have a central plateau in the timing. The actuation signal with the second signal waveform is used if the activation of the magnetic actuator by means of the actuation signal with a first signal waveform leads in the plateau area to an undesired premature closure of the injector needle. This contributes to enabling an especially small injection mass to be metered especially precisely. The fact that the signal waveform has a plateau in the middle of its timing waveform means in this context that for example the signal waveform in the area of the plateau has a sine wave or rectangular oscillation of which the amplitude however is small in relation to the global maximum and of which the mean value is constant in the area of the plateau. Further the periodic signal waveform in the area of the plateau in the center of the timing leads to an injection mass which corresponds to a constant signal waveform in the area of the plateau.

In a further embodiment an operating variable is monitored of which the value is representative for an actual value of a metered injection mass. An undesired closing of the injector needle is detected if a difference between the actual value of the metered injection mass and a setpoint value of the metered injection mass is greater than a first predetermined threshold value. This makes it possible to easily recognize whether the injector needle is closing early in an undesired way.

In a further embodiment an operating variable is monitored of which the value is representative for an actual value of a metering time during which the injector needle is outside its closed position. The undesired premature closure of the injector needle is detected if a difference between the actual value of the metering time and a setpoint value of the metering time is greater than a second predetermined threshold value. This makes it possible to easily recognize whether the injector needle is closing early in an undesired way.

In a further embodiment the magnetic actuator is activated as a function of the actuation signal with the first signal waveform if a fluid pressure in the injection valve is less than a third predetermined threshold value. The magnetic actuator is activated depending on the actuation signal with the second signal waveform if the fluid pressure in the injection valve is greater than the third predetermined threshold value. This makes it easy to take account of the fluid pressure in the injection valve during the selection of the signal waveform. This contributes to an especially reliable metering of the fluid by means of the injection valve.

In a further embodiment the magnetic actuator his first activated during the metering process with the actuation signal with one of the two signal waveforms and then with the actuation signal with the other of the two signal waveforms.

An injection valve (FIG. 1) comprises a fuel supply 2, a nozzle body 4 and a housing 6. The nozzle body 4 is coupled mechanically to the housing 6 via a nozzle body sleeve 7. The injection valve is suitable for metering a fluid, for example for metering of fuel for a combustion process in a combustion chamber of an internal combustion engine.

The nozzle body 4 has a recess 8 in the nozzle body 4. An injector needle 10 is arranged for axial movement in the recess 8 of the nozzle body 4. The injector needle 10 is coupled to an armature 12. A spring 14 applies a first force acting in the closure direction of the injector needle 10 to the injector needle 10 and the armature 12. The fuel feed 2 has a recess 16 in the fuel feed 2. Furthermore the armature 12 has a recess 18 in the armature 12. Arranged in the recess 16 of the fuel feed 2 there may be preferably a calibration body 22.

At an axial end of the injection valve facing away from the fuel feed 2 the injection valve features a metering opening 24. The metering opening 24 is embodied in an injector needle seat 26. To guide the injector needle 10 a lower guide element 28 is provided in the area of the injector needle seat 26. Arranged between the lower guide element 28 and the injector needle seat 26 is an atomizer disk 30.

A magnetic actuator of the injection valve comprises a magnetic coil 36 and the armature 12. The magnetic coil 36 can also be designated as the magnet unit of the magnetic actuator. To control the solenoid actuator a voltage is applied by means of an output stage 35 to the magnetic coil 36. As an alternative the output stage 35 can be a current source. The output stage 35 features a number of electrical components, for example resistors, capacitors and/or coils. The electrical energy from the output stage 35 is converted in the magnetic coil 36 into magnetic energy which exerts a second force on the armature 12, which, depending on the polarity which is applied to the magnetic coil 36 with the current or the voltage, acts against the closure direction of the injector needle 10 or in the closure direction of the injector needle 10. A third force on the injector needle 10 is exerted by the fluid in the injection valve. Whether the injector needle 10 is in its closed position or outside its closed position depends on a force balance of the first to third forces. If the injector needle 10 is outside is closed position, fluid can flow via a fuel inlet 42 through a filter 44 to a fluid feed 58 in the injector needle 10 and be metered through the metering opening 24.

Figure 2:
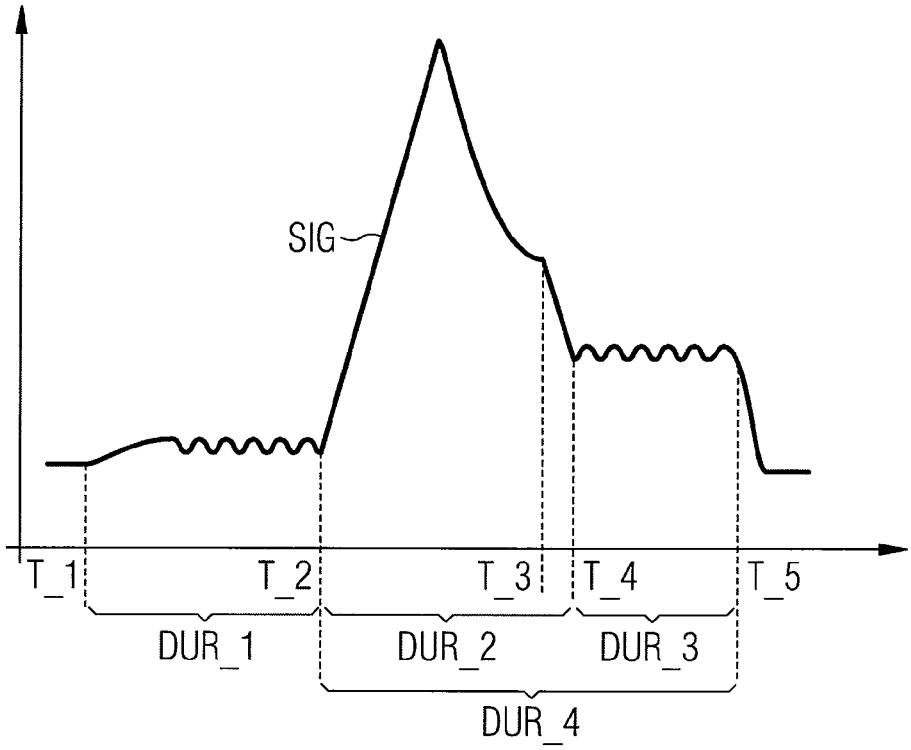
FIG. 2 a signal waveform of an actuation signal for activating the injection valve, FIG. 3 a first signal waveform of the actuation signal and a second signal waveform of the actuation signal, FIG. 4 a flowchart of a program for metering of fluid.

The injection valve, especially the magnetic actuator of the injection valve, preferably may have an actuation signal applied to it by means of the output stage 35, which has a predetermined signal waveform SIG (FIG. 2). During a first duration DUR_1, which elapses between a first point in time T-1 and a second point in time T-2, the magnetic coil 36 may preferably be charged up so that the injector needle 10 does not move out of its closed position. During the first duration DUR_1 the signal waveform SIG thus has a first plateau in the center of its timing. In this area the energy surplus, especially the voltage or the current, applied to the magnetic coil 36 can be constant, or it can fluctuate around a constant mean value, for example as a sine wave or square wave.

At the second point in time T-2 the magnetic coil is charged with magnetic energy precisely so that the injector needle 10 does not enable the flow of fluid through the metering opening 24. The first duration DUR_1 is followed by a second duration DUR_2 up to a third point in time T-3 and/or a fourth point in time T-4. During the second duration DUR_2 so much energy is applied to the magnetic coil 36 that the injector needle 10 may preferably open completely and releases the flow of fluid through the metering opening. Once the injector needle 10 is opened, little energy is needed subsequently in order to hold the injector needle 10 open. Thus the second duration DUR_2 is followed by a third duration DUR_3 which ends at a fifth point in time T-5, during which the injector needle 10 is held open and during which lower maximum energy is applied to the magnetic coil than during the second duration DUR_2. After the point in time T-5 the magnetic coil 36 is no longer supplied with energy, especially for example the applied voltage is set to zero potential or the current is switched off. Thus the injector needle 10, during a fourth duration DUR_4, which includes the second and the third duration DUR_2, DUR_3, is outside its closed position. An injection mass, which for example is determined by a control device of the internal combustion engine, can be metered by specifying the third or fourth duration DUR_3, DUR_4.

So as to preferably obtain the smallest possible injection masses of the fluid to be injected, preferably as little energy as possible may be transmitted with the actuation signal to the magnetic actuator. Because of manufacturing tolerances however the minimum energy which is needed to open the injector needle 10 and/or to hold it open varies from injection valve to injection valve and/or from output stage 35 to output stage 35 of the same design. In particular the features of the resistors, the coils and/or the capacitors of the final stage 35 can vary.

Figure 3:
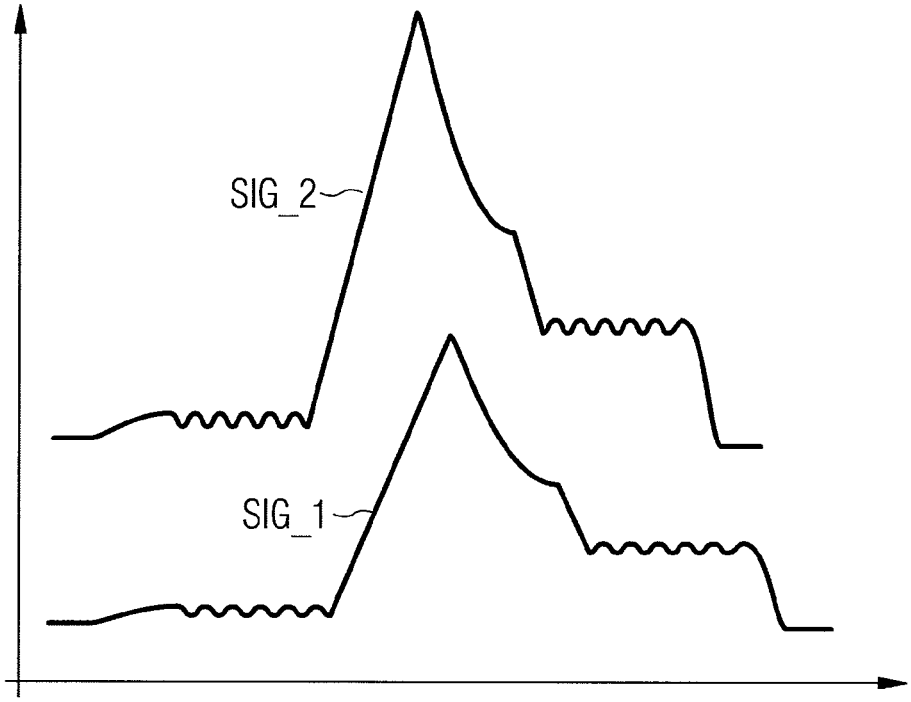

Thus at least one first signal waveform SIG_1 and a second signal waveform SIG_2 are held on a memory medium of the control device (FIG. 3). The two signal waveforms essentially differ in that, with the first signal waveform SIG_1, less energy is transmitted to the magnetic actuator than with the second signal waveform SIG_2.

Figure 4:
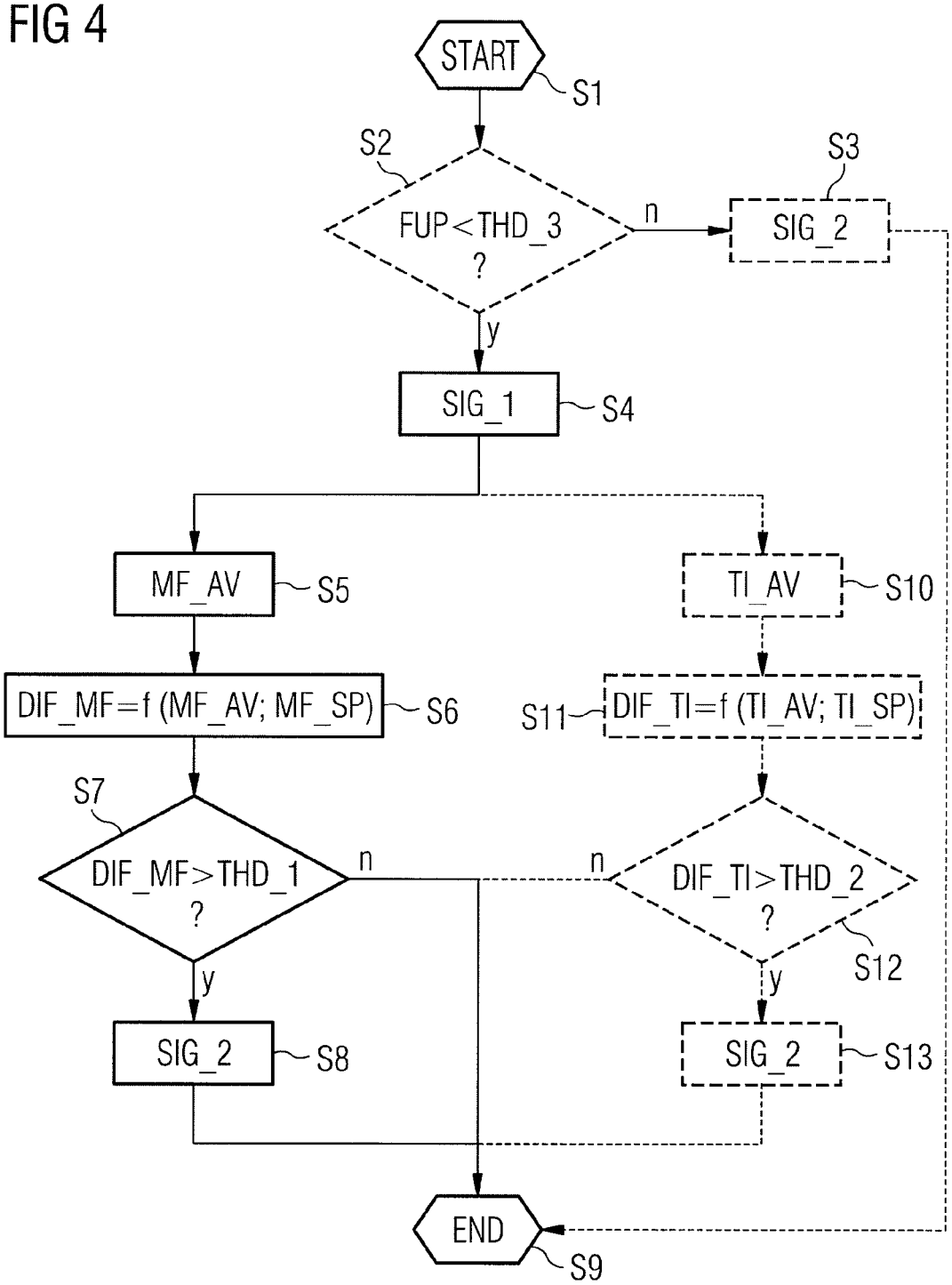

Preferably a program (FIG. 4) for activating the magnetic actuator can be stored on the memory medium. The program serves to activate the injection valve with the first signal waveform SIG_1 or with the second signal waveform SIG_2.

The program may preferably be started in a step S1 in which variables are initialized if necessary.

In a step S2 a check is performed as to whether a fluid pressure FUP in the injection valve is smaller than a predetermined third threshold value THD_3. If the condition of step S2 is fulfilled, processing is continued in a step S4. If the condition of step S2 is not fulfilled, processing is continued in a step S3.

In step S3 the magnetic actuator is activated with the actuation signal with the second signal waveform SIG_2.

As an alternative the program can also be processed without steps S2 and S3.

In step S4 the magnetic actuator is activated with the actuation signal with the first signal waveform SIG_1.

In a step S5 an actual value MP_AV of an injection mass is determined.

In a step S6 a difference DIF_MF of the injection mass is determined as a function of the actual value MF_AV of the injection mass and a setpoint value MF_SP of the injection mass. The setpoint value MF_SP of the injection mass is determined for example by the control device of the internal combustion engine.

In a step S7 a check is performed as to whether the difference DIF_MF of the injection mass is greater than a predetermined first threshold value THD_1. If the condition of step S7 is fulfilled, processing is continued in a step S8. If the condition of the step S7 is not fulfilled, processing is continued in a step S9.

In step S8 the magnetic actuator is activated with the actuation signal with the second signal waveform SIG_2.

Steps S4 to S8 can be processed during a single metering process, in other words during a single opening phase, of the injection valve. Thus the magnetic actuator can be activated with two different actuation signals during an opening phase. As an alternative steps S4 to S8 can be split between consecutive metering processes, so that in a first metering process of the magnetic actuator the actuation signal is activated with the first signal waveform SIG_1 and in a second metering process, which follows on directly from the first metering process for example, it can be activated with the actuation signal with the second signal waveform SIG_2.

Steps S10 to S13 can also be processed as an alternative or in parallel to steps S5 to S8.

In step S10 an actual value TI_AV of an injection time is determined.

In a step S11, depending on the actual value TI_AV and a setpoint value TI_SP of the injection time, a difference DIF_TI of the injection time is determined. The setpoint required value TI_SP of the injection time may preferably be determined by the control device.

In a step S12 a check is made as to whether the difference DIF_TI of the injection time is greater than a predetermined second threshold value THD_2. If the condition of step S12 is fulfilled, processing is continued in a step S13. If the condition of step S12 is not fulfilled the processing is continued in step S9.

In step S13 the magnetic actuator is activated with the actuation signal with the second signal waveform SIG_2. In accordance with steps S4 to S8, steps S4 to S13 can also be processed during an injection process or during consecutive injection processes.

The program can be ended in a step S9. Preferably the program may however be executed regularly during operation, for example in each injection process. As an alternative the program can continue to be executed after a predetermined number of injection processes.

The program thus serves to compensate for component tolerances of manufacturing tolerances which cause premature closure of the injector needle 10, by switching in a timely manner to the actuation signal with the second signal waveform SIG_2. If the especially small injection mass is to be brought about by the second signal waveform SIG_2, then for example the third or fourth duration DUR_3, DUR_4 can be selected to be very short.

What is claimed is:

1. A method for metering a fluid by means of an injection valve which comprises a magnetic actuator and an injector needle able to be moved axially by means of the magnetic actuator, the method comprising the steps of:

activating the magnetic actuator for an individual injection process with at least one actuation signal with a first signal waveform or with an actuation signal with a second signal waveform, wherein the two actuation signals at least differ from one another in that, on activation of the magnetic actuator by means of the actuation signal with the first signal waveform, less energy is transmitted to a magnet unit of the magnetic actuator than on activation of the magnetic actuator by means of the actuation signal with the second signal waveform, activating the magnetic actuator by means of the actuation signal with the second signal waveform if an activation of the magnetic actuator by means of the actuation signal with the first signal waveform leads to an undesired premature closure of the injector needle.

2. The method according to claim 1, wherein the two signal waveforms each feature a global maximum and a plateau in the timing waveform after the global maximum in the middle of the timing and wherein the actuation signal is used with the second signal waveform if the activation of the magnetic actuator by means of the actuation signal with the first signal waveform in the area of the plateau leads to an undesired premature closure of the injector needle.

3. The method according to claim 1, wherein an operating variable is monitored, the value of which is representative of an actual value of a measured injection mass, and in which the undesired premature closure of the injector needle is detected, if a difference between the actual value of the measured injection mass and a setpoint value of the measured injection mass is greater than a first predetermined threshold value.

4. The method according to claim 1, wherein an operating variable is monitored of which the value is representative for an actual value of an injection duration during which the injector needle is outside its closed position, and in which the undesired premature closure of the injector needle is detected if a difference between the actual value of the injection duration and a setpoint value of the injection duration is greater than a second predetermined threshold value.

5. The method according to claim 1, wherein the magnetic actuator is activated as a function of the first actuation signal with the first signal waveform if a fluid pressure in the injection valve is smaller than a third predetermined threshold value and in which the magnetic actuator is activated as a function of the actuation signal with the second signal waveform if the fluid pressure in the injection valve is greater than the third predetermined threshold value.

6. The method according to claim 1, wherein, during an individual injection process the magnetic actuator is initially activated with the actuation signal with one of the two signal waveforms and then with the actuation signal with the other of the two signal waveforms.

7. A device for metering of a fluid by means of an injection valve, comprising a magnetic actuator and an injector needle able to be moved axially by the magnetic actuator, wherein the device is operable:

to activate the magnetic actuator for an individual injection process with at least one actuation signal with a first signal waveform or with an actuation signal with a second signal waveform, wherein the two actuation signals at least differing from each other in that, on activation of the magnetic actuator by means of the actuation signal with the first signal waveform less energy is transmitted to a magnet unit of the magnetic actuator than during activation of the magnetic actuator by means of the actuation signal with the second signal waveform, and to activate the magnetic actuator by means of the actuation signal with the second signal waveform if an activation of the magnetic actuator by means of the actuation signal with the first signal waveform leads to an undesired premature closure of the injector needle.

8. The device according to claim 7, wherein the two signal waveforms each feature a global maximum and a plateau in the timing waveform after the global maximum in the middle of the timing and wherein the actuation signal is used with the second signal waveform if the activation of the magnetic actuator by means of the actuation signal with the first signal waveform in the area of the plateau leads to an undesired premature closure of the injector needle.

9. The device according to claim 7, wherein an operating variable is monitored, the value of which is representative of an actual value of a measured injection mass, and in which the undesired premature closure of the injector needle is detected, if a difference between the actual value of the measured injection mass and a setpoint value of the measured injection mass is greater than a first predetermined threshold value.

10. The device according to claim 7, wherein an operating variable is monitored of which the value is representative for an actual value of an injection duration during which the injector needle is outside its closed position, and in which the undesired premature closure of the injector needle is detected if a difference between the actual value of the injection duration and a setpoint value of the injection duration is greater than a second predetermined threshold value.

11. The device according to claim 7, wherein the magnetic actuator is activated as a function of the first actuation signal with the first signal waveform if a fluid pressure in the injection valve is smaller than a third predetermined threshold value and in which the magnetic actuator is activated as a function of the actuation signal with the second signal waveform if the fluid pressure in the injection valve is greater than the third predetermined threshold value.

12. The device according to claim 7, wherein, during an individual injection process the magnetic actuator is initially activated with the actuation signal with one of the two signal waveforms and then with the actuation signal with the other of the two signal waveforms.

13. A method for metering a fluid by means of an injection valve which comprises a magnetic actuator and an injector needle able to be moved axially by means of the magnetic actuator, the method comprising the steps of:

activating the magnetic actuator for an individual injection process with one of two actuation signals, wherein the first actuation signal has a first signal waveform causing less energy to be transmitted to a magnet unit of the magnetic actuator than by the second actuation signal having a second signal waveform, activating the magnetic actuator by the second actuation signal if an activation of the magnetic actuator by the first actuation signal leads to an undesired premature closure of the injector needle.

14. The method according to claim 13, wherein the first and second signal waveforms each comprise a global maximum and a plateau in the timing waveform after the global maximum in the middle of the timing.

15. The method according to claim 13, wherein an operating variable is monitored, the value of which is representative of an actual value of a measured injection mass, and in which the undesired premature closure of the injector needle is detected, if a difference between the actual value of the measured injection mass and a setpoint value of the measured injection mass is greater than a first predetermined threshold value.

16. The method according to claim 13, wherein an operating variable is monitored of which the value is representative for an actual value of an injection duration during which the injector needle is outside its closed position, and in which the undesired premature closure of the injector needle is detected if a difference between the actual value of the injection duration and a setpoint value of the injection duration is greater than a second predetermined threshold value.

17. The method according to claim 13, wherein the magnetic actuator is activated as a function of the first actuation signal if a fluid pressure in the injection valve is smaller than a third predetermined threshold value and wherein the magnetic actuator is activated as a function of the second actuation signal if the fluid pressure in the injection valve is greater than the third predetermined threshold value.

18. The method according to claim 13, wherein, during an individual injection process the magnetic actuator is initially activated with one of the two actuation signal and then with the actuation signal with the other of the two signal waveforms.

* * * * *